US008138680B2

(12) United States Patent
Pan

(10) Patent No.: US 8,138,680 B2
(45) **Date of Patent: *Mar. 20, 2012**

(54) LIGHT STRING WITH EXTERNAL RESISTOR UNIT

(76) Inventor: Kuo-An Pan, Hong Kong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 12/813,824

(22) Filed: Jun. 11, 2010

(65) Prior Publication Data

US 2010/0244712 A1 Sep. 30, 2010

Related U.S. Application Data

(63) Continuation of application No. 11/627,808, filed on Jan. 26, 2007, now Pat. No. 7,750,576.

(30) Foreign Application Priority Data

Mar. 1, 2006 (CN) ..... 2006 2 0055822 U

(51) Int. Cl.
*H05B 37/00* (2006.01)

(52) U.S. Cl. ..... 315/185 R; 315/185 S; 315/122

(58) Field of Classification Search ..... 315/185 R, 315/185 S, 200 R, 291, 312; 362/227, 252, 362/568, 654, 800, 806, 812; 345/39, 46, 345/82

See application file for complete search history.

(56) References Cited

U.S. PATENT DOCUMENTS 4,855,880 A * 8/1989 Mancusi Jr. ..... 362/123
6,157,139 A * 12/2000 Gibboney, Jr. ..... 315/185 S
6,283,612 B1 9/2001 Hunter
6,344,716 B1 * 2/2002 Gibboney, Jr. ..... 315/185 S
6,346,777 B1 * 2/2002 Kim ..... 315/185 S
6,583,550 B2 6/2003 Iwasa et al.
6,682,205 B2 1/2004 Lin
6,866,398 B2 * 3/2005 Lin ..... 362/249.04
7,227,314 B1 6/2007 Gaeta et al.
7,748,866 B2 7/2010 Pan
7,928,664 B2 * 4/2011 Beland ..... 315/276
2002/0145392 A1 10/2002 Hair et al.
2002/0191416 A1 * 12/2002 Wesson ..... 362/555
2002/0195945 A1 12/2002 Gershen et al.
2003/0063463 A1 * 4/2003 Sloan et al. ..... 362/238
2003/0071581 A1 4/2003 Panagotacos et al.
2004/0183458 A1 * 9/2004 Lee ..... 315/185 R
2004/0252501 A1 * 12/2004 Moriyama et al. ..... 362/238
2005/0063181 A1 * 3/2005 Chiba et al. ..... 362/226
2006/0193131 A1 8/2006 McGrath et al.
2006/0203482 A1 9/2006 Allen et al.
2007/0063657 A1 3/2007 Wu
2007/0070622 A1 3/2007 Allen
2007/0096661 A1 * 5/2007 Allen ..... 315/207
2007/0164683 A1 7/2007 Allen
2007/0291341 A1 12/2007 Pan
2008/0310183 A1 12/2008 Fan
2009/0122538 A1 5/2009 Pan

OTHER PUBLICATIONS

U.S. Appl. No. 11/730,397, Apr. 2, 2007, Pan.

* cited by examiner

*Primary Examiner* — Tung X Le
(74) *Attorney, Agent, or Firm* — Oblon, Spivak, McClelland, Maier & Neustadt, L.L.P.

(57) ABSTRACT

An LED light string including a first loop, which further includes a first plurality of LEDs in series successively connected by first connecting wires, and at least one first resistor connected to two first resistor wires, the first two resistor wires removably connected to two of the first connecting wires in any portion of the first loop.

18 Claims, 3 Drawing Sheets

LIGHT STRING WITH EXTERNAL RESISTOR UNIT

CROSS REFERENCE TO RELATED APPLICATIONS

This application is a continuation of U.S. application Ser. No. 11/627,808, filed Jan. 26, 2007, now U.S. Pat. No. 7,750,576, and is based upon and claims the benefits of priority from the prior Chinese Patent Application No. 200620055822.0, filed on Mar. 1, 2006, the entire contents of each of which are incorporated herein by reference.

BACKGROUND OF THE INVENTION

1. Field of the Invention

The present invention is generally related to a light string, and more particularly, the present invention relates to a light string employing light emitting diodes (LEDs) with a constant voltage supply and voltage adjustable characteristics.

2. Discussion of the Background

LED-based light strings are used for a variety of applications, primarily for decorative purposes such as for Christmas lighting. LEDs are increasingly employed as a basic lighting source in a variety of forms, as LEDs have several favorable physical properties, such as cool operation and ability to operate under wide temperature variations. LEDs are currently available in many colors, allowing for light strings available in different colors or multicolors. An LED light string with different color LEDs typically requires different voltages for the different color LEDs. For example, the average voltage operating a white LED varies in a range from 3.0 to 3.6 volts, while the average voltage operating a red LED varies in a range from 1.8 volt to 2.2 volts.

Generally, light strings employ LEDs connected electrically in series rather than in parallel. One particular drawback to these types of light strings is that when an LED is removed from its support socket, the entire series is rendered inoperable. In a conventional light string that employs LEDs connected electrically in parallel, a plurality of light strings with LEDs in a parallel connection are coupled in a shunt circuit fashion to form a light string block, and a resistor is engaged in series between the power supply and the light string block. However, the regulating resistor is firmly welded in the string and incapable of being replaced. Thus, when the respective light strings of the block have different voltage requirements, the resistor in series cannot perform a regulating function due to different voltage requirements of different colored light strings.

In another conventional light string with LEDs connected in parallel, each of the LEDs employs a resistor in either an input connection or an output connection serving a regulating purpose. However, in the forementioned conventional light string, each of the LEDs has to be welded with a regulating resistor, which results in difficult manufacturing issues. In addition, during a welding process, the LEDs are often destroyed. Moreover, the welding renders the resistor unreplaceable. Further, when the voltage is insufficient, luminosity of the LEDs is low, and when the voltage is grossly excessive, the LEDs will burn out.

SUMMARY OF THE INVENTION

The present invention broadly comprises a light string with an external resistor. One aspect of the invention includes an LED light string including a first loop, which further includes a first plurality of LEDs in series successively connected by first connecting wires, and at least one first resistor connected to two first resistor wires, the first two resistor wires removably connected to two of the first connecting wires in any portion of the first loop.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
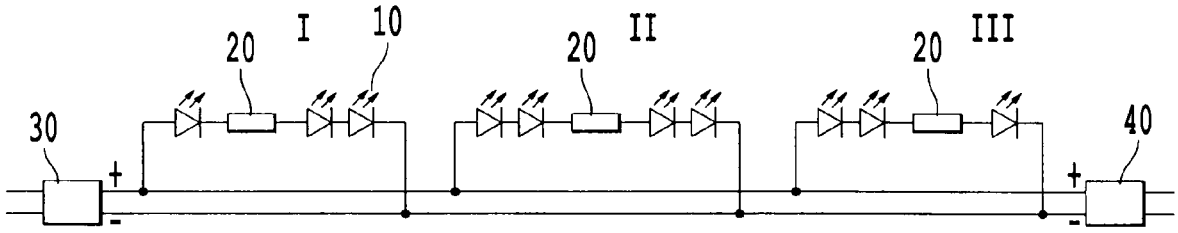
FIG. 1 is a schematic diagram of an LED light string according to an embodiment of the present invention.

Referring now to the drawings, wherein like reference numerals designate identical or corresponding parts throughout the several views.

Figure 2:
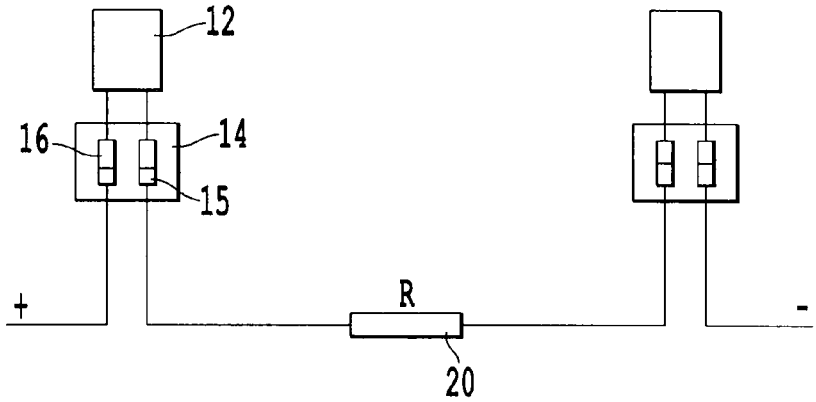
FIG. 2 is a schematic diagram of two LEDs and a resistor.

Reference is made to FIGS. 1 and 2 which respectively illustrate schematic diagrams of an LED light string and LEDs employed in the LED light string. The LED light string shown is capable of providing constant voltage to respective loops in a parallel connection with a regulated power supply.

In one embodiment of the present invention, an LED light string comprises one LED loop or a plurality of LED loops, a power plug 30, and an expansion plug 40. The embodiment shown in FIG. 1 includes three LED loops identified by reference numerals I, II, and III. The LED loops I, II, and III are respectively coupled to the same power supply in parallel. Each of the loops I, II, and III comprises a plurality of LEDs 10 coupled in series. The power plug 30 of the LED light string is coupled to an alternating current power supply, and the expansion plug 40 can be connected to a power plug of another LED light string for a relaying purpose. Thus, a plurality of LED light strings can be successively coupled.

Each of the loops I, II, and III may include a resistor 20 in a series connection with the LEDs. The resistor 20 can be arranged at any place between the first LED and the last LED of each LED loop I or II or III. The resistor 20 can be integrally engaged with a connecting wire in the medium arrangement, by means of molding.

FIG. 2 illustrates that the connecting wires coupled to the resistor 20 may include two free end terminals 15. The terminals 15 function as joint members between adjacent LEDs in series. The resistor 20 may be engaged with connecting wires between the first LED and the last LED of each LED loop. Due to the replaceable connection advantage of the connecting wire together with the resistor 20, it is feasible and convenient to replace the resistor 20 by detaching the free end terminals 15. The resistors 20 in different loops I, II, and III respectively serve to keep a constant average voltage across the strings. Accordingly, a regulating resistor having a first value can be easily replaced with a regulating resistor of a second value if the source voltage used with the LED string is changed.

In one embodiment, the resistance value of resistor 20 is set to the ratio of (1) the difference between the average voltage of the common U.S. household power of 110 VAC and the consumption voltage of all the LEDs 10 of the loop I or II or III, to (2) the average current through the LEDs. In one embodiment the resistance value is 500 Ohms. In another embodiment the resistance value is greater than 500 Ohms.

As shown in FIG. 2, each of the LEDs 10 may include a bulb 12, a lamp bracket 14, and a pair of contacts 16 extending from the bottom of the bulb 12. The pair of contacts 16 is inserted into the lamp bracket 14 along a pair of guide ways (not shown) and then received in the bracket 14. The two free end terminals 15 of the connecting wire coupled to the resistor 20 are respectively inserted in to the lamp bracket 14 along the pair of guide ways and then coupled to the contacts 16 of the LEDs. Thus, a circuit is completed, allowing electricity to flow uninterrupted. The resistor 20 is removably or integrally engaged with the connecting wire in the medium arrangement, and in series connection between two adjacent lamp brackets 14 by the connection wire.

In practice, when replacing the resistor 20 to alter the value for regulating voltage purposes, the terminals 15 of the connecting wire incorporating the resistor 20 between the adjacent lamp brackets 14 are detached. Another connecting wire incorporating a resistor with the required resistance value is then attached instead. After the terminals 15 of the replacing connecting wire are respectively received in the lamp bracket 14 and connected with corresponding contacts 16 of the LED 10, the replacement process is complete. In another embodiment, the resistor can be removably connected to the connecting wires by solder.

Figure 3:
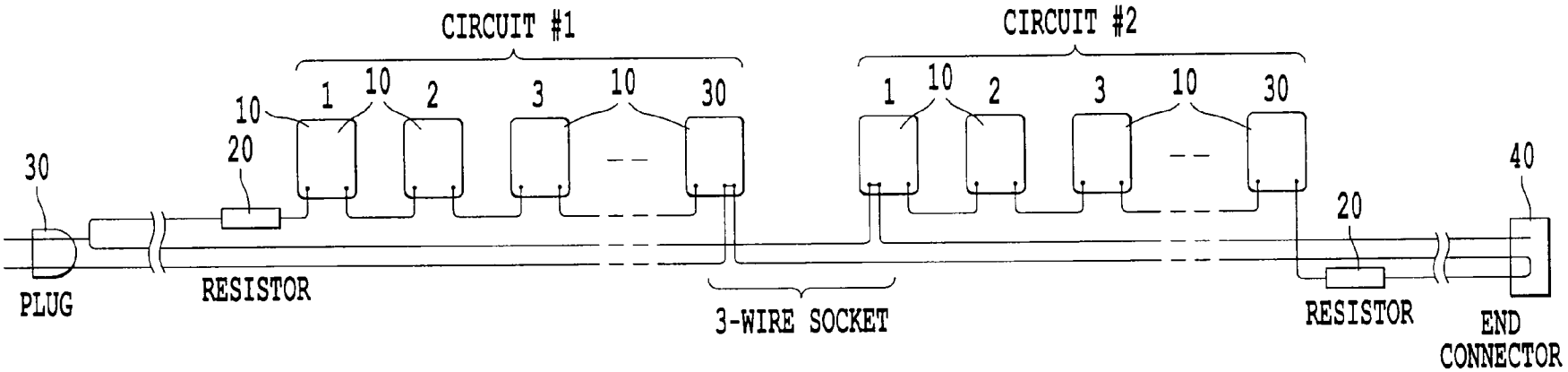
FIG. 3 is a schematic diagram of an LED light string according to an embodiment of the present invention.

Another embodiment of the present invention is shown in FIG. 3. In this embodiment, a resistor 20 can be connected in series between the last LED 10 of circuit #2 and the expansion plug 40. Similarly, a resistor 20 can be connected in series between a power plug 30 and the first LED 10 of circuit #1.

Figure 4:
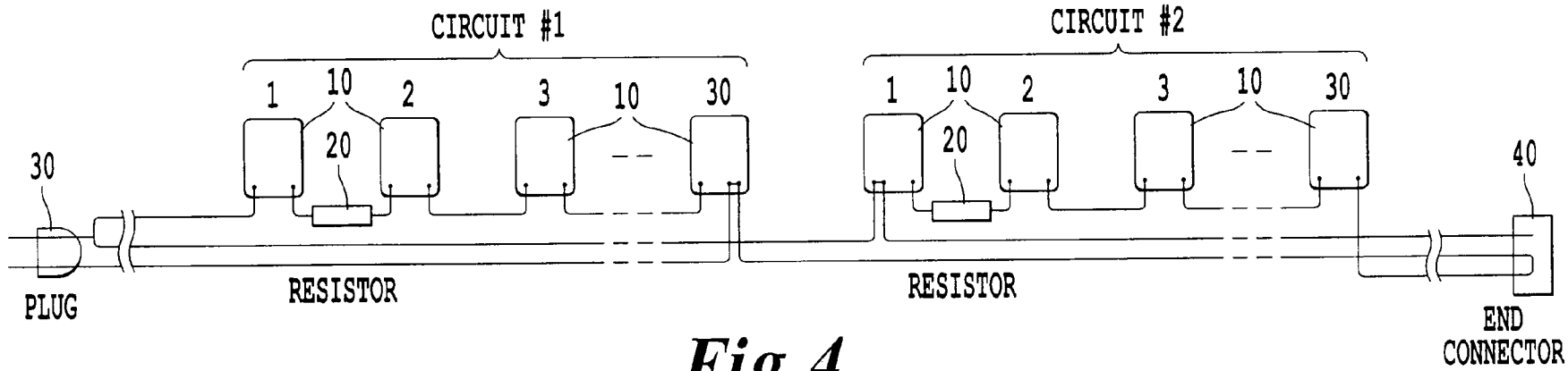
FIG. 4 is a schematic diagram of an LED light string according to an embodiment of the present invention.

Yet another embodiment of the present is shown in FIG. 4. In this embodiment, a resistor 20 can be removably or integrally connected in series between two LEDs 10 in circuit #1. Similarly, a resistor 20 can be removably or integrally connected in series between two LEDs in circuit #2. Any number of LEDs can be in any given circuit. It is also envisioned that there can be more than two circuits in a light string.

Figure 5:
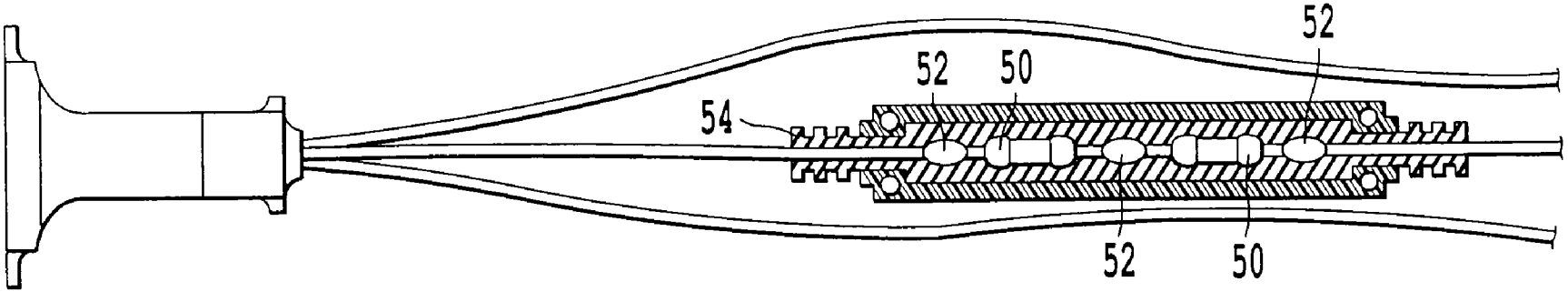
FIG. 5 is a cross-sectional view of a resistor and a casing according to an embodiment of the present invention.

FIG. 5 is a cross-sectional view of resistors 50 connected to resistor wires 58. The resistor wires are removably engaged with connecting wires 56. The resistor wires 58 are connected to connecting wires 56 by solder 52. FIG. 5 also shows two resistors 50 connected in series via resistor wires 58, by means of solder 52. However, it is envisioned that other connecting means are possible. Also shown in FIG. 5 is a casing 54 surrounding the resistors 50. The casing 54 protects the resistors from impact and the elements. The casing 54 could be made of, for example, plastic or rubber.

Obviously, numerous modifications and variations of the present invention are possible in light of the above teachings. It is therefore to be understood that within the scope of the appended claims, the invention may be practiced otherwise than as specifically described herein.

The invention claimed is:

1. An LED light string, comprising:

a first loop including, a first plurality of LEDs in series successively connected by first connecting wires, and at least one first resistor connected to two first resistor wires, the first two resistor wires removably connected to two of the first connecting wires in any portion of the first loop such that the at least one first resistor is in series with the first plurality of LEDs, the first resistor surrounded by a casing, said casing not surrounding any of said first plurality of LEDs, the first resistor being a separate element from the first plurality of LEDs and separated from the first plurality of LEDs by the two first resistor wires which are flexible wires.

2. The LED light string as recited in claim 1, wherein the first two resistor wires are removably connected to the first connecting wires by soldering.

3. The LED light string as recited in claim 1, wherein the at least first resistor is removably connected between two adjacent LEDs.

4. The LED light string as recited in claim 1, wherein the at least first resistor is removably connected between a power plug and a LED.

5. The LED light string as recited in claim 1, wherein the first resistor has a value of 500 Ohms.

6. The LED light string as recited in claim 1, wherein the first resistor is integrally formed with the first resistor wires.

7. The LED light string as recited in claim 1, further comprising:

a second loop including, a second plurality of LEDs in series successively connected by second connecting wires, and at least one second resistor connected to two second resistor wires, the second two resistor wires removably connected to two of the second connecting wires in any portion of the second loop.

8. The LED light string as recited in claim 7, wherein the second two resistor wires are removably connected to the second connecting wires by soldering.

9. The LED light string as recited in claim 1, wherein at least one of the first plurality of LEDs includes a socket configured to receive one of the two first resistor wires such that the one of the two first resistor wires is removably electrically connected to the at least one of the first plurality of LEDs.

10. An LED light string, comprising:

a first loop including, a first plurality of LEDs in series successively connected by first connecting wires, and at least one first resistor connected to two first resistor wires, the first two resistor wires removably connected by first means for connecting to two of the first connecting wires such that the at least one first resistor is in series with the first plurality of LEDs, the first resistor surrounded by a casing, said casing not surrounding any of said first plurality of LEDs, the first resistor being a separate element from the first plurality of LEDs and separated from the first plurality of LEDs by the two first resistor wires which are flexible wires.

11. The LED light string as recited in claim 10, wherein the first means for connecting is solder.

12. The LED light string as recited in claim 10, wherein the at least first resistor is removably connected by first means for connecting between two adjacent LEDs.

13. The LED light string as recited in claim 10, wherein the at least first resistor is removably connected by first means for connecting between a power plug and a LED.

14. The LED light string as recited in claim 10, wherein the first resistor has a value of 500 Ohms.

15. The LED light string as recited in claim 10, wherein the first resistor is integrally formed with the first resistor wires.

16. The LED light string as recited in claim 10, further comprising:

a second loop including, a second plurality of LEDs in series successively connected with second connecting wires, and at least one second resistor connected by two second resistor wires, the second two resistor wires removably connected by second means for connecting to two of the second connecting wires.

17. The LED light string as recited in claim 16, wherein the second means for connecting is solder.

18. The LED light string as recited in claim 10, wherein at least one of the first plurality of LEDs includes a socket configured to receive one of the two first resistor wires such that the one of the two first resistor wires is removably electrically connected to the at least one of the first plurality of LEDs.

* * * * *